US009733610B2

(12) United States Patent
Konishi

(10) Patent No.: US 9,733,610 B2
(45) Date of Patent: Aug. 15, 2017

(54) IMAGE FORMING APPARATUS

(71) Applicant: KYOCERA Document Solutions Inc., Osaka (JP)

(72) Inventor: Hirohito Konishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/227,466

(22) Filed: Aug. 3, 2016

(65) Prior Publication Data

US 2017/0052505 A1 Feb. 23, 2017

(30) Foreign Application Priority Data

Aug. 17, 2015 (JP) ..... 2015-160317

(51) Int. Cl.
*G03G 15/00* (2006.01)
*G03G 21/16* (2006.01)
*G03G 21/18* (2006.01)

(52) U.S. Cl.
CPC ..... *G03G 21/1652* (2013.01); *G03G 21/1676* (2013.01); *G03G 21/1871* (2013.01)

(58) Field of Classification Search
CPC ..... G03G 21/1652; G03G 21/1676; G03G 21/1871
See application file for complete search history.

(56) References Cited

U.S. PATENT DOCUMENTS

2005/0191079 A1* 9/2005 Yokoi ..... G03G 21/1871 399/90

FOREIGN PATENT DOCUMENTS

JP 2008-197588 A 8/2008
JP 2009-205082 A 9/2009

* cited by examiner

*Primary Examiner* — Hoang Ngo
(74) *Attorney, Agent, or Firm* — Stein IP, LLC

(57) ABSTRACT

An image forming apparatus of the present disclosure includes a unit, a high-voltage contact point pin, and a protective member. The unit is mountable/demountable with respect to a main body of the image forming apparatus. With the unit mounted in the main body of the image forming apparatus, the high-voltage contact point pin is in contact with a contact point terminal that is provided at the unit. With the unit mounted in the main body of the image forming apparatus, the protective member is disposed at a first position at which a tip end of the high-voltage contact point pin being in contact with the contact point terminal is exposed, and with the unit demounted from the main body of the image forming apparatus, the protective member is disposed at a second position at which the tip end of the high-voltage contact point pin is covered.

7 Claims, 5 Drawing Sheets

IMAGE FORMING APPARATUS

INCORPORATION BY REFERENCE

This application is based upon and claims the benefit of priority from the corresponding Japanese Patent Application No. 2015-160317 filed on Aug. 17, 2015.

BACKGROUND

The present disclosure relates to an image forming apparatus, such as a copy machine, a printer, a facsimile, or the like, including an image carrier and a transfer roller that transfers a toner image formed on the image carrier onto a recording medium.

Conventionally, in an image forming apparatus employing an electrophotographic process, the following method has generally been adopted. That is, an electrostatic latent image is formed on an image carrier (photosensitive drum) whose surface is uniformly charged, and by use of a developing unit, a toner image based on the electrostatic latent image is formed on the image carrier. Then, by use of a transfer member, such as a transfer roller, that forms a transfer nip portion between itself and the photosensitive drum, the toner image formed on the image carrier is transferred onto a paper sheet that is conveyed to the transfer nip portion, after which the paper sheet is passed through a fixing unit so that the toner image is fixed on the paper sheet.

There is known a configuration in which a developing unit is mountable/demountable with respect to a main body of an image forming apparatus. In a case of occurrence of a paper jam inside the image forming apparatus, a developing device is demounted from the image forming apparatus so that a jammed paper sheet can be removed. Furthermore, the developing unit includes a contact point that allows the developing unit to be mounted in either of two types of image forming apparatuses different in mounting/demounting direction of an imaging cartridge (developing unit), and thus whether the developing unit is mounted in one or the other of these two types of image forming apparatuses, electrical connection to a contact point member of the one or the other of these types of image forming apparatuses can be performed with reliability.

SUMMARY

An image forming apparatus according to one aspect of the present disclosure includes a unit, a high-voltage contact point pin, and a protective member. The unit is mountable/demountable with respect to a main body of the image forming apparatus. With the unit mounted in the main body of the image forming apparatus, the high-voltage contact point pin is in contact with a contact point terminal that is provided at the unit. With the unit mounted in the main body of the image forming apparatus, the protective member is disposed at a first position at which a tip end of the high-voltage contact point pin being in contact with the contact point terminal is exposed, and with the unit demounted from the main body of the image forming apparatus, the protective member is disposed at a second position at which the tip end of the high-voltage contact point pin is covered.

Still other objects of the present disclosure and specific advantages provided by the present disclosure will be made further apparent from the following description of an embodiment.

DETAILED DESCRIPTION

Figure 1:
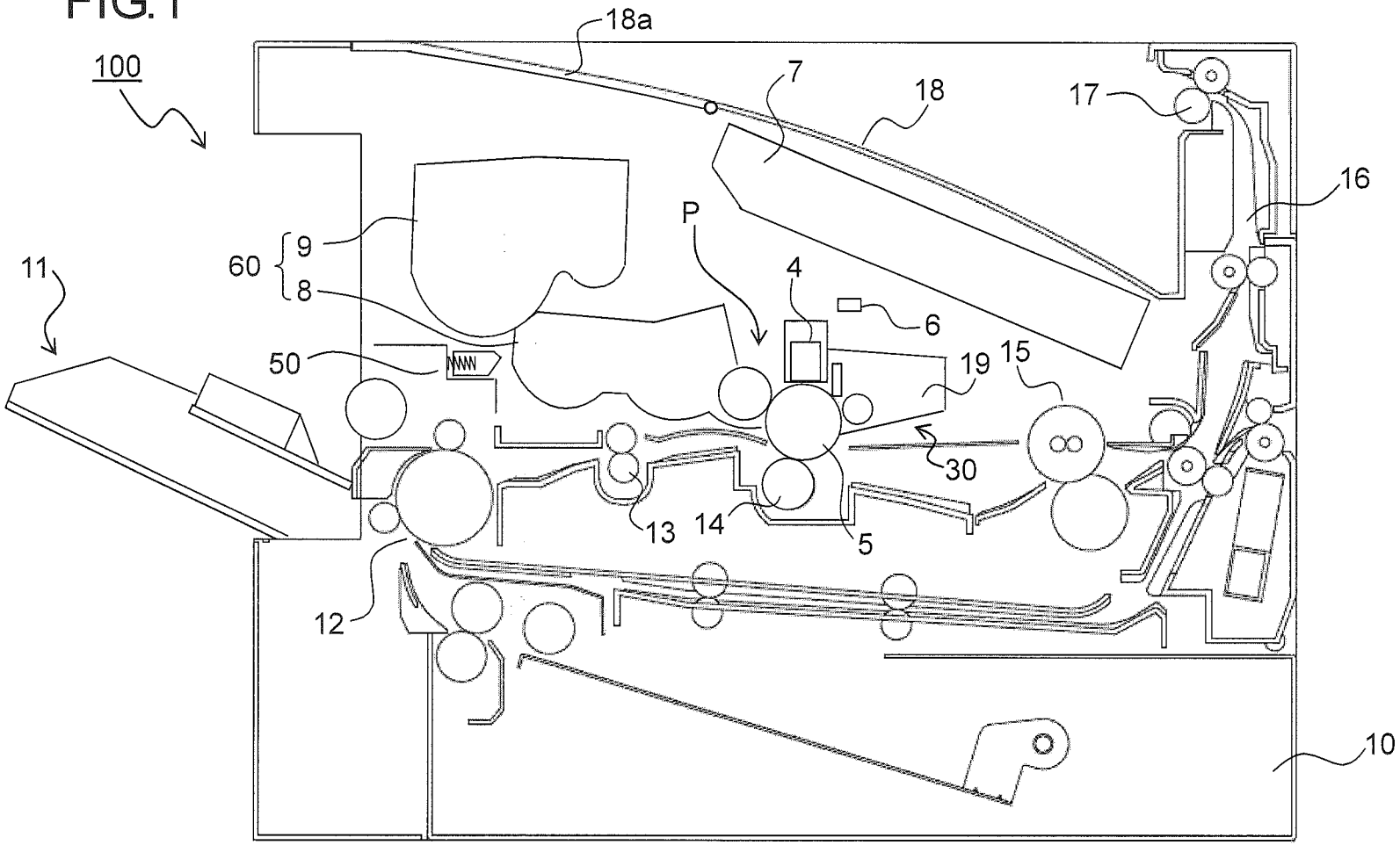
FIG. 1 is a side sectional view showing an internal structure of an image forming apparatus 100 according to one embodiment of the present disclosure.

With reference to the appended drawings, the following describes an embodiment of the present disclosure. FIG. 1 is a side sectional view showing an internal structure of an image forming apparatus 100 according to one embodiment of the present disclosure. In the image forming apparatus (herein, a monochrome printer) 100, an image forming portion P is arranged that forms a monochrome image by following steps of charging, exposure, development, and transfer. In the image forming portion P, along a rotation direction of a photosensitive drum 5 (a counterclockwise direction in FIG. 1), a charging device 4, an exposure unit (a laser scanning unit or the like) 7, a developing device 8, a transfer roller 14, a cleaning device 19, and a static eliminating device 6 are arranged.

In a case of performing an image forming operation, the photosensitive drum 5 that rotates in the counterclockwise direction is uniformly charged by the charging device 4. Next, by using a laser beam from the exposure unit 7, which is based on original document image data, an electrostatic latent image is formed on the photosensitive drum 5. Next, by the developing device 8, a developer (hereinafter, referred to as toner) is made to adhere to the electrostatic latent image, and thus a toner image is formed.

The developing device 8 is supplied with toner from a toner container 9. Image data is transmitted from a personal computer (not shown) or the like. Furthermore, the static eliminating device 6 that eliminates residual electrical charge on a surface of the photosensitive drum 5 is provided on a downstream side of the cleaning device 19 with respect to the rotation direction of the photosensitive drum 5.

The charging device 4, the photosensitive drum 5, and the cleaning device 19 are integrated as a unit, and the developing device 8 and the toner container 9 are integrated as a unit. The unit composed of the charging device 4, the photosensitive drum 5, and the cleaning device 19 is hereinafter referred to as a drum unit 30. Furthermore, the unit composed of the developing device 8 and the toner container 9 is hereinafter referred to as a developing unit 60. The drum unit 30 and the developing unit 60 are each mountable/demountable with respect to a main body of the image forming apparatus 100.

Toward the photosensitive drum 5 on which the toner image has been formed in the above-described manner, from a paper feed cassette 10 or a manual paper feed device 11, a paper sheet is conveyed via a paper sheet conveyance path 12 and a registration roller pair 13, and the toner image formed on the surface of the photosensitive drum 5 is transferred onto the paper sheet by the transfer roller 14. The paper sheet onto which the toner image has been transferred is separated from the photosensitive drum 5 and conveyed to the fixing device 15 where the toner image is fixed. The paper sheet that has passed through the fixing device 15 is conveyed to an upper portion in the apparatus through a paper sheet conveyance path 16 and ejected onto an ejection tray 18 by an ejection roller pair 17.

At an upper surface of the image forming apparatus 100, an open/close cover 18*a* is provided that constitutes a part of the ejection tray 18. In a state where the open/close cover 18*a* is opened, the drum unit 30 and the developing unit 60 are inserted into the main body of the image forming apparatus 100 or drawn out from the main body of the image forming apparatus 100. Furthermore, a lock mechanism 50 that holds the developing unit 60 at a prescribed position in the main body of the image forming apparatus 100 is provided on an upstream side in an insertion direction of the developing unit 60 so as to be adjacent to the developing unit 60.

Figure 2:
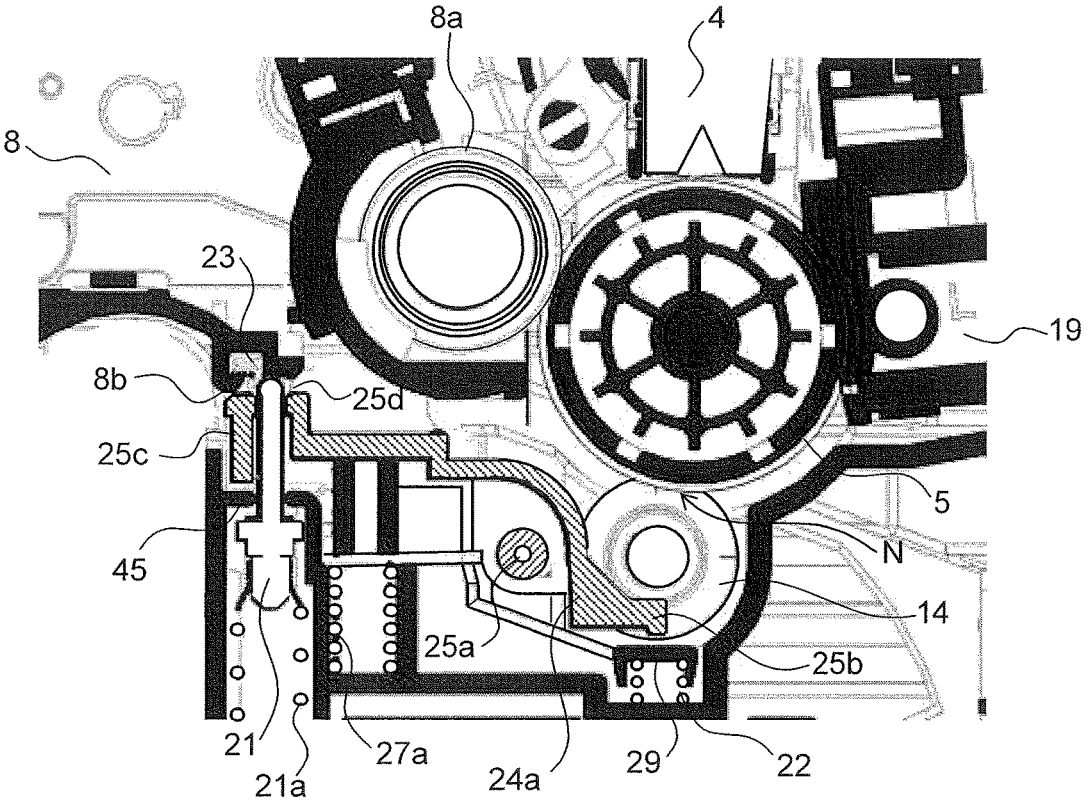
FIG. 2 is a partial enlarged view of a vicinity of one end portion of a transfer roller 14 where a pressure release lever 24*a* is disposed.

FIG. 2 is a partial enlarged view of a vicinity of one end portion of the transfer roller 14 (a left side as seen from an upstream side in a paper sheet conveyance direction) where a pressure release lever 24*a* is disposed. In a state shown in FIG. 2 where the drum unit 30 and the developing unit 60 have been inserted to respective prescribed positions in the main body of the image forming apparatus 100, the developing device 8 is disposed at a position (developing position) at which a developing roller 8*a* comes in contact with the photosensitive drum 5. At this time, a high-voltage contact point pin 21 on a main body side of the image forming apparatus 100 and a contact point terminal 23 on a developing device 8 side are in contact with each other, and thus it is made possible to apply a developing bias from a high-voltage substrate (not shown) in the image forming apparatus 100 to the developing roller 8*a* via the high-voltage contact point pin 21 and the contact point terminal 23. The high-voltage contact point pin 21 is biased in an upward direction by a contact point pressing spring 21*a*.

Furthermore, the photosensitive drum 5 is in contact with the transfer roller 14 to form a transfer nip portion N. The transfer roller 14 is rotatably supported to the main body of the image forming apparatus 100 and is biased in such a direction as to approach the photosensitive drum 5 by a pressure adjusting spring 22. At both end portions of the transfer roller 14 in an axial direction thereof, the pressure release levers 24*a* and 24*b* that release a pressure contact state of the transfer roller 14 with respect to the photosensitive drum 5 are disposed, respectively. A configuration of the pressure release lever 24*b* at the other end portion of the transfer roller 14 in the axial direction thereof (a right side as seen from the upstream side in the paper sheet conveyance direction) will be discussed later.

The pressure release lever 24*a* is supported to the main body of the image forming apparatus 100 so as to be swingable about a circularly moving shaft 25*a*. The pressure release lever 24*a* has a pressing portion 25*b* that is formed at an end portion thereof on a transfer roller 14 side and a tube-shaped portion 25*c* that is formed at an end portion thereof on a side opposite to the pressing portion 25*b*. The pressing portion 25*b* is disposed at a position opposed to a spring receiving portion 29 that receives an upper end of the pressure adjusting spring 22 of the transfer roller 14. The high-voltage contact point pin 21 is disposed inside the tube-shaped portion 25*c*, and an opening portion 25*d* through which a tip end portion of the high-voltage contact point pin 21 protrudes is formed through an upper surface of the tube-shaped portion 25*c*.

Furthermore, below the pressure release lever 24*a*, a pressure release spring 27*a* is disposed that biases the pressure release lever 24*a* in a clockwise direction in FIG. 2. A biasing force of the pressure release spring 27*a* is set to be larger than a biasing force of the pressure adjusting spring 22 that biases the transfer roller 14 in such a direction as to approach the photosensitive drum 5 and smaller than a pressing force that is exerted on the pressure release lever 24*a* as a result of mounting the developing unit 60.

Figure 3:
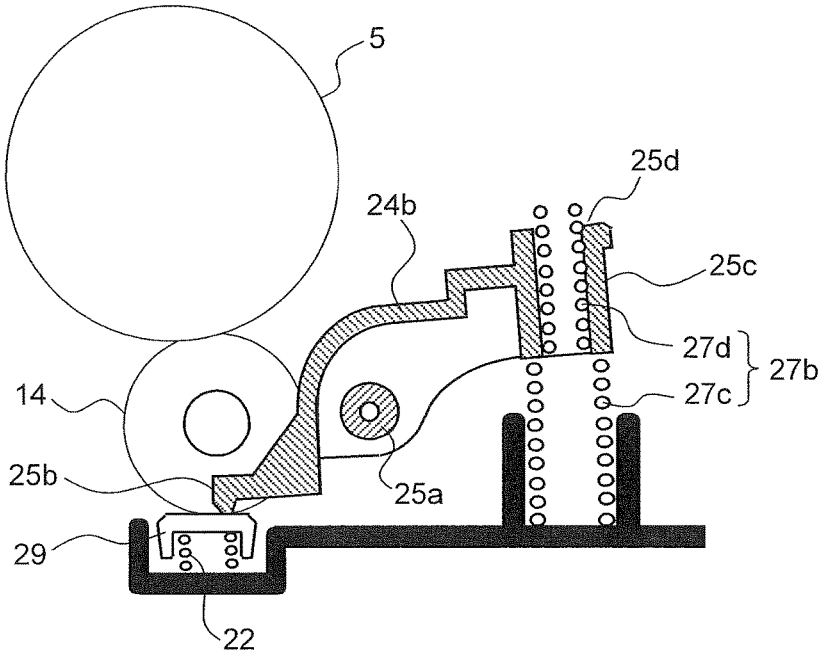
FIG. 3 is a partial enlarged view of a vicinity of the other end portion of the transfer roller 14 where a pressure release lever 24*b* is disposed.

FIG. 3 is a partial enlarged view of a vicinity of the other end portion of the transfer roller 14 (the right side as seen from the upstream side in the paper sheet conveyance direction) where the pressure release lever 24*b* is disposed. The pressure release lever 24*b* has a substantially similar configuration to that of the pressure release lever 24*a*, i.e., is supported to the main body of the image forming apparatus 100 so as to be swingable about the circularly moving shaft 25*a* and has a pressing portion 25*b* and a tube-shaped portion 25*c*.

Furthermore, below the pressure release lever 24*b*, a pressure release spring 27*b* is disposed that biases the pressure release lever 24*b* in a counterclockwise direction in FIG. 3. The pressure release spring 27*b* has a large diameter portion 27*c* that has a diameter larger than an inner diameter of the tube-shaped portion 25*c* and a small diameter portion 27*d* that is internally inserted into the tube-shaped portion 25*c*. A biasing force of the large diameter portion 27*c* is set to be larger than a biasing force of the pressure adjusting spring 22 that biases the transfer roller 14 in such a direction as to approach the photosensitive drum 5 and smaller than a pressing force that is exerted on the pressure release lever 24*b* as a result of mounting the developing unit 60. A lower end portion of the large diameter portion 27*c* is grounded to a ground via a metal frame (not shown) of the main body of the image forming apparatus 100. A tip end of the small diameter portion 27*d* protrudes through an opening portion 25*d* at an upper surface of the tube-shaped portion 25*c*.

Figure 4:
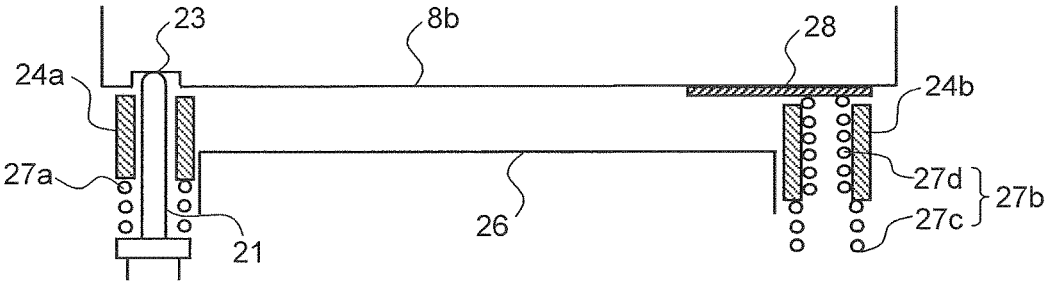
FIG. 4 is a sectional view, as seen from an upstream side in a paper sheet conveyance direction, of a positional relationship between a developing device 8 and the pressure release levers 24*a* and 24*b* in a state where a developing unit 60 is mounted in a main body of the image forming apparatus 100.

FIG. 4 is a sectional view, as seen from the upstream side in the paper sheet conveyance direction (a left direction in FIG. 1), of a positional relationship between the developing device 8 mounted in the main body of the image forming apparatus 100 and the pressure release levers 24*a* and 24*b*. A housing 8*b* of the developing device 8 comes in contact with the upper surface of the tube-shaped portion 25*c* of each of the pressure release levers 24*a* and 24*b*, and thus the pressure release spring 27*a* and the large diameter portion 27*c* of the pressure release spring 27*b* are compressed. This causes the pressing portion 25*b* of each of the pressure release levers 24*a* and 24*b* to move away from the spring receiving portion 29, so that by a biasing force of the pressure adjusting spring 22, the transfer roller 14 is brought into pressure contact with the photosensitive drum 5.

At this time, while the pressure release lever 24*a* circularly moves in a counterclockwise direction in FIG. 2, the high-voltage contact point pin 21 is biased in the upward direction by the contact point pressing spring 21*a*. As a result, the high-voltage contact point pin 21 is disposed at a position (hereinafter, referred to as a first position) at which it protrudes through the opening portion 25*d* of the tube-shaped portion 25*c*.

Furthermore, the pressure release lever 24*b* circularly moves in a clockwise direction in FIG. 3, and the small diameter portion 27*d* of the pressure release spring 27*b*, which is internally inserted into the tube-shaped portion 25*c*, is pressed within the tube-shaped portion 25*c* up to the upper surface thereof, after which it also circularly moves in the clockwise direction in FIG. 3 together with the pressure release lever 24*b*. Further, the tip end of the small diameter portion 27*d* on which a biasing force (restoring force) is exerted in such a direction that the tip end of the small diameter portion 27*d* protrudes through the opening portion 25*d* of the tube-shaped portion 25*c* comes in contact with a metal plate 28 that is attached to a bottom surface of the housing 8*b* of the developing device 8.

The bottom surface of the housing 8*b* serves as an upper conveyance guide opposed to a lower conveyance guide 26 that conveys a paper sheet to the transfer nip portion N. Accordingly, through the contact between the small diameter portion 27*d* of the pressure release spring 27*b* and the metal plate 28, the bottom surface of the housing 8*b* is grounded, so that static electricity is eliminated therefrom, and thus it is possible to prevent a paper sheet from being electrically attracted to the bottom surface of the housing 8. That is, the pressure release spring 27*b* on a pressure release lever 24*b* side serves also as a grounding member for grounding the bottom surface of the housing 8*b*.

Figure 5:
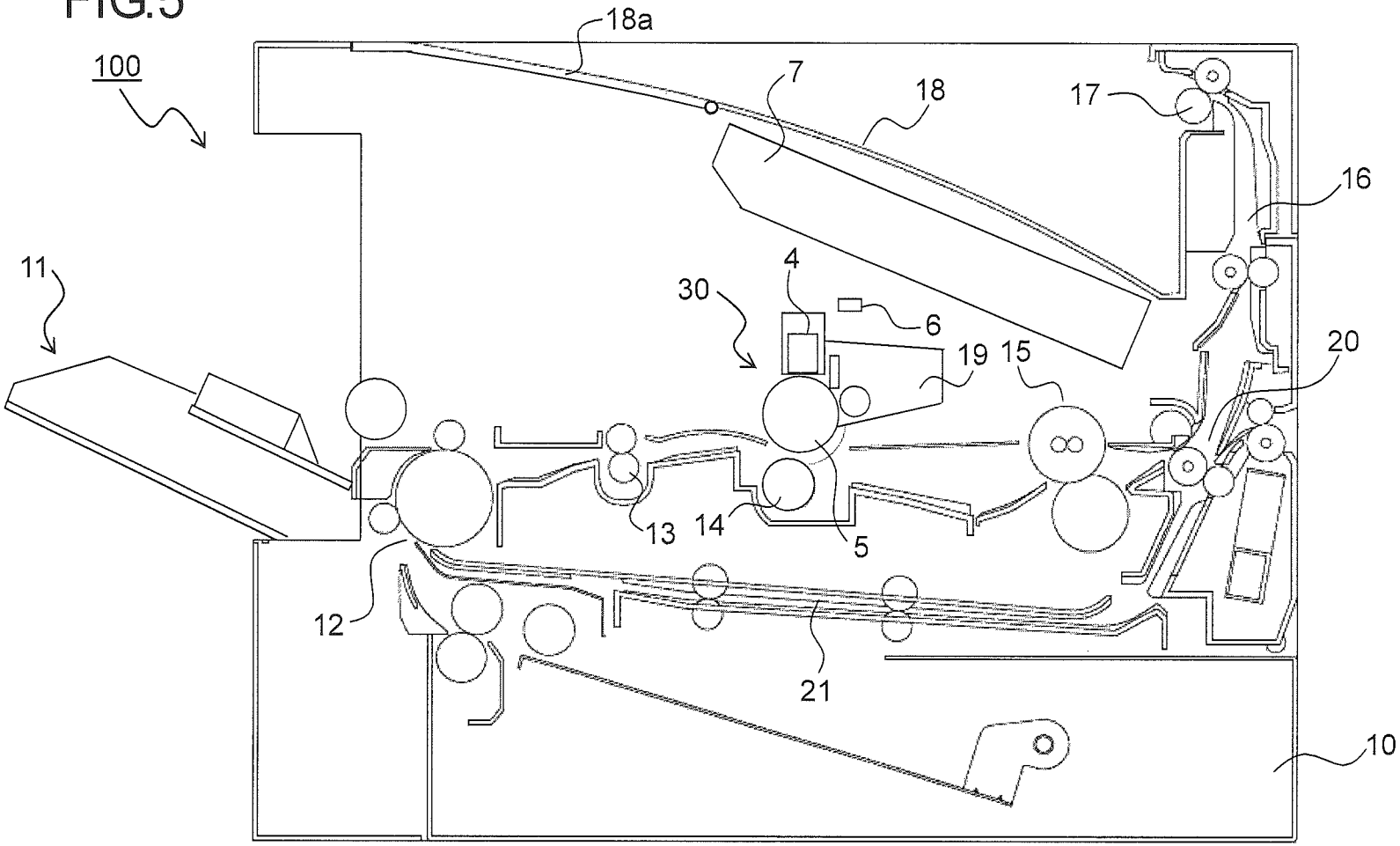
FIG. 5 is a side sectional view of the image forming apparatus 100 in a state where the developing unit 60 has been demounted.
Figure 6:
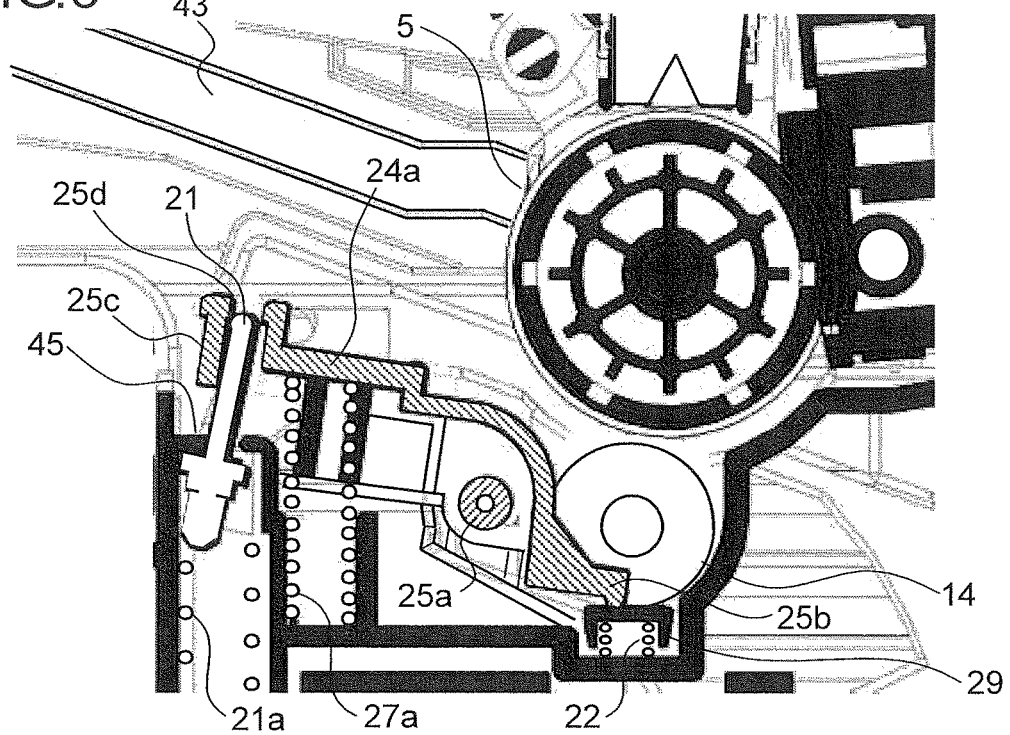
FIG. 6 is a partial enlarged view of a vicinity of a photosensitive drum 5 in the state shown in FIG. 5.
Figure 7:
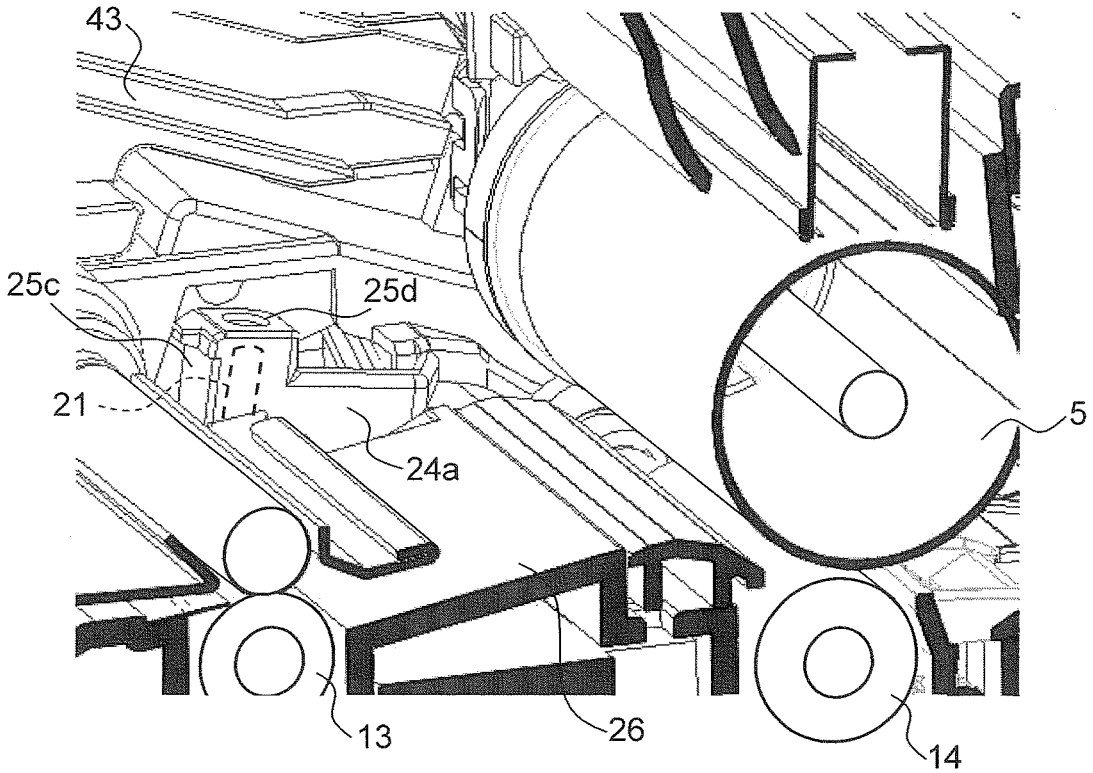
FIG. 7 is a partial perspective view, as seen from the upstream side in the paper sheet conveyance direction, of the vicinity of the photosensitive drum 5 in the state shown in FIG. 5.

FIG. 5 is a side sectional view of the image forming apparatus 100 in a state where the developing unit 60 (the developing device 8, the toner container 9) has been demounted, FIG. 6 is a partial enlarged view of a vicinity of the photosensitive drum 5 in the state shown in FIG. 5, and FIG. 7 is a partial perspective view, as seen from the upstream side in the paper sheet conveyance direction (a left direction in FIG. 3), of the vicinity of the photosensitive drum 5 in the state shown in FIG. 5.

When the drum unit 30 is inserted into/pulled out from the image forming apparatus 100, a drum bearing (not shown) into which a center shaft of the photosensitive drum 5 is inserted is engaged with a guide groove 43. A positioning portion (not shown) is formed at an end portion of the guide groove 43 on a downstream side with respect to an insertion direction of the drum unit 30. In a state where the developing unit 60 is mounted, the center shaft of the photosensitive drum 5 is disposed at the positioning portion, and as shown in FIG. 2, the photosensitive drum 5 and the transfer roller 14 are in contact with each other to form the transfer nip portion N.

When the developing unit 60 is pulled out from the main body of the image forming apparatus 100, a pressing force by the developing unit 60 is no longer exerted on the pressure release levers 24*a* and 24*b*. As a result, as shown in FIG. 6, by a biasing force (restoring force) of the pressure release spring 27*a*, the pressure release lever 24*a* is caused to swing in a clockwise direction from the state shown in FIG. 2. Similarly, by a biasing force (restoring force) of the large diameter portion 27*c* of the pressure release spring 27*b*, the pressure release lever 24*b* is caused to swing in a counterclockwise direction from a state shown in FIG. 3.

Here, since the respective biasing forces of the pressure release springs 27*a* and 27*b* are larger than a biasing force of the pressure adjusting spring 22, the pressing portion 25*b* of each of the pressure release levers 24*a* and 24*b* presses down the spring receiving portion 29, so that the transfer roller 14 moves in such a direction as to be away from the photosensitive drum 5. As a result, a pressure contact state between the photosensitive drum 5 and the transfer roller 14 is released.

Furthermore, as the pressure release lever 24*a* swings in the clockwise direction, the tube-shaped portion 25*c* also moves upward. On the other hand, the high-voltage contact point pin 21 moves upward for a prescribed amount by a biasing force of the contact point pressing spring 21*a*, after which upward movement thereof is restricted by a restricting portion 45 that is formed at the lower conveyance guide 26. As a result, the pressure release lever 24*a* is disposed at a position (hereinafter, referred to as a second position) at which the upper surface of the tube-shaped portion 25*c* is equal in level to the tip end of the high-voltage contact point pin 21 or becomes higher in level than the tip end of the high-voltage contact point pin 21, namely, a position at which the tip end portion of the high-voltage contact point pin 21 is covered.

According to a configuration of this embodiment, in conjunction with an operation in which the developing unit 60 is pulled out from the main body of the image forming apparatus 100, the pressure release lever 24*a* swings from the first position to the second position to release a nip between the photosensitive drum 5 and the transfer roller 14. Consequently, a paper sheet nipped at the transfer nip portion N can be easily removed, and thus it is possible to suppress a scratch on the surface of the photosensitive drum 5 caused by a paper sheet rubbing the surface of the photosensitive drum 5. Furthermore, when the drum unit 30 is pulled out from the image forming apparatus 100, no interference occurs between the photosensitive drum 5 and the transfer roller 14, and thus it is possible to prevent the photosensitive drum 5 from being damaged due to contact with the transfer roller 14.

Moreover, when a pressure contact state between the photosensitive drum 5 and the transfer roller 14 has been released, the pressure release lever 24*a* is disposed at the second position at which the tube-shaped portion 25*c* covers the tip end of the high-voltage contact point pin 21. This eliminates a possibility that, at the time of clearing a paper jam or at the time of performing a replacing operation or a maintenance operation of the developing unit 60 and the drum unit 30, an operator accidentally damages the high-voltage contact point pin 21 or gets injured by accidentally touching the high-voltage contact point pin 21. Thus, the image forming apparatus 100 is obtained that achieves improvements in ease of clearing a paper jam and in ease of maintenance.

Other than the above, the present disclosure is not limited to the above-described embodiment, and various modifications thereto are possible without departing from the spirit of the present disclosure. For example, while the above-described embodiment has a configuration in which the tube-shaped portion 25*c* is provided at the pressure release lever 24*a*, and the high-voltage contact point pin 21 is disposed inside the tube-shaped portion 25*c*, the pressure release lever 24*a* is not limited in shape thereto and may have any other shape that allows the high-voltage contact point pin 21 to be protected. Furthermore, while the pressure release lever 24*a* that releases a nip pressure between the photosensitive drum 5 and the transfer roller 14 is used as a protective member that protects the high-voltage contact point pin 21 at the time of drawing out the developing unit 60, in place of the pressure release lever 24*a*, a dedicated protective member may be disposed that moves between the first position and the second position depending on an operation of mounting/demounting the developing unit 60.

Furthermore, while the above-described embodiment describes a configuration for protecting the high-voltage contact point pin 21 that supplies power to the developing device 8 as a component constituting the developing unit 60, in an exactly similar manner, this configuration can be applied also to a case of protecting a high-voltage contact point pin that supplies power to any other mountable/demountable unit such as the drum unit 30, the fixing unit, or the like.

Furthermore, needless to say, the present disclosure is not limited to a monochrome printer as shown in FIG. 1 but can be applied also to an image forming apparatus of any other type including a mountable/demountable unit, such as a color printer, a monochrome and color copy machine, a digital multifunctional peripheral, a facsimile, or the like.

The present disclosure is applicable to an image forming apparatus including a unit that is mountable/demountable with respect to a main body of the image forming apparatus. Through the use of the present disclosure, there can be provided an image forming apparatus that protects, by using a simple configuration, a high-voltage contact point pin that supplies power to a unit, thereby providing improved operability in mounting/demounting the unit and also being able to secure safety of an operator.

What is claimed is:

1. An image forming apparatus, comprising:

a unit that is mountable/demountable with respect to a main body of the image forming apparatus;

a high-voltage contact point pin that, with the unit mounted in the main body of the image forming apparatus, is in contact with a contact point terminal that is provided at the unit; and a protective member that, with the unit mounted in the main body of the image forming apparatus, is disposed at a first position at which a tip end of the high-voltage contact point pin being in contact with the contact point terminal is exposed, and with the unit demounted from the main body of the image forming apparatus, is disposed at a second position at which the tip end of the high-voltage contact point pin is covered wherein the protective member has a tube-shaped portion that encloses the high-voltage contact point pin, and with the unit mounted in the main body of the image forming apparatus, the protective member is disposed at the first position at which the tip end of the high-voltage contact point pin protrudes through an opening portion that is formed through an upper surface of the tube-shaped portion, and with the unit demounted from the main body of the image forming apparatus, the protective member is disposed at the second position as a result of the tube-shaped portion moving in a direction toward the tip end of the high-voltage contact point pin.

2. The image forming apparatus according to claim 1, wherein the unit is a developing unit that develops an electrostatic latent image formed on an image carrier into a toner image, and the protective member is a pressure release lever that releases a pressure contact state between the image carrier and a transfer member that comes in contact with the image carrier and transfers a toner image formed on the image carrier onto a recording medium.

3. The image forming apparatus according to claim 2, further comprising:

a first biasing member that biases the transfer member in such a direction as to approach the image carrier; and a second biasing member that biases the pressure release lever in a direction toward the second position and has a biasing force larger than a biasing force of the first biasing member, wherein with the developing unit demounted from the main body of the image forming apparatus, by the biasing force of the second biasing member, the pressure release lever moves from the first position to the second position to cause the transfer member to move, against the biasing force of the first biasing member, in such a direction as to be away from the image carrier and thus releases a pressure contact state between the image carrier and the transfer member, and with the developing unit mounted in the main body of the image forming apparatus, the pressure release lever moves, against the biasing force of the second biasing member, from the second position to the first position to cause the transfer member to move, by the biasing force of the first biasing member, in such a direction as to approach the image carrier and thus brings the image carrier and the transfer member to a pressure contact state.

4. The image forming apparatus according to claim 3, wherein a bottom surface of the developing unit functions as a conveyance guide that conveys a recording medium to a pressure contact portion between the image carrier and the transfer member, as the pressure release lever, a pair of pressure release levers are disposed at both end portions of the transfer member in an axial direction thereof, respectively, and one of the pair of pressure release levers is the protective member, and the second biasing member that biases the other of the pair of pressure release levers in the direction toward the second position serves also as a grounding member for grounding the bottom surface of the developing unit.

5. An image forming apparatus, comprising:

a unit that is mountable/demountable with respect to a main body of the image forming apparatus;

a high-voltage contact point pin that, with the unit mounted in the main body of the image forming apparatus, is in contact with a contact point terminal that is provided at the unit; and a protective member that, with the unit mounted in the main body of the image forming apparatus, is disposed at a first position at which a tip end of the high-voltage contact point pin being in contact with the contact point terminal is exposed, and with the unit demounted from the main body of the image forming apparatus, is disposed at a second position at which the tip end of the high-voltage contact point pin is covered, wherein the unit is a developing unit that develops an electrostatic latent image formed on an image carrier into a toner image, and the protective member is a pressure release lever that releases a pressure contact state between the image carrier and a transfer member that comes in contact with the image carrier and transfers a toner image formed on the image carrier onto a recording medium.

6. The image forming apparatus according to claim 5, further comprising:

a first biasing member that biases the transfer member in such a direction as to approach the image carrier; and a second biasing member that biases the pressure release lever in a direction toward the second position and has a biasing force larger than a biasing force of the first biasing member, wherein with the developing unit demounted from the main body of the image forming apparatus, by the biasing force of the second biasing member, the pressure release lever moves from the first position to the second position to cause the transfer member to move, against the biasing force of the first biasing member, in such a direction as to be away from the image carrier and thus releases a pressure contact state between the image carrier and the transfer member, and with the developing unit mounted in the main body of the image forming apparatus, the pressure release lever moves, against the biasing force of the second biasing member, from the second position to the first position to cause the transfer member to move, by the biasing force of the first biasing member, in such a direction as to approach the image carrier and thus brings the image carrier and the transfer member to a pressure contact state.

7. The image forming apparatus according to claim 6, wherein a bottom surface of the developing unit functions as a conveyance guide that conveys a recording medium to a pressure contact portion between the image carrier and the transfer member, as the pressure release lever, a pair of pressure release levers are disposed at both end portions of the transfer member in an axial direction thereof, respectively, and one of the pair of pressure release levers is the protective member, and the second biasing member that biases the other of the pair of pressure release levers in the direction toward the second position serves also as a grounding member for grounding the bottom surface of the developing unit.

* * * * *